US006915533B1

(12) United States Patent
Gorobets

(10) Patent No.: US 6,915,533 B1
(45) Date of Patent: Jul. 12, 2005

(54) FOOT ASSISTED PLUNGER CONSTRUCTION

(76) Inventor: Mark Gorobets, 12130 Genoa St., Warm Mineral Springs, FL (US) 34287

( * ) Notice: Subject to any disclaimer, the term of this patent is extended or adjusted under 35 U.S.C. 154(b) by 0 days.

(21) Appl. No.: 10/971,807

(22) Filed: Oct. 22, 2004

(51) Int. Cl.[7] ..... E03D 11/00
(52) U.S. Cl. ..... 4/255.11
(58) Field of Search ..... 4/255.01, 255.05, 4/255.11, 255.12

(56) References Cited

U.S. PATENT DOCUMENTS 3,644,943 A 2/1972 Parodi
fu Leonardo et al. ..... 4/255
4,745,641 A 5/1988 Tash ..... 4/255
5,335,374 A 8/1994 Wilk et al. ..... 4/255.11
5,353,442 A 10/1994 Rotter ..... 4/255.11
6,374,427 B1 4/2002 Tash ..... 4/255.11

*Primary Examiner*—Tuan Nguyen
(74) *Attorney, Agent, or Firm*—Sturm & Fix LLP

(57) ABSTRACT

An improvement for a plunger construction (10) having one of a variety of standard configuration deformable plunger cup members (40) provided with a mounting receptacle (43) where the improvement includes an elongated D-shaped handle member (20) having a pair of elongated support arms (22) (22) connected on their upper ends by a handle element (23) and connected on their lower ends by a base plate (24) to define a foot receiving opening (21) wherein, the base plate (24) is further provided with an adapter element (26) engageable in the mounting receptacle (43) of the plunger cup member (40).

5 Claims, 1 Drawing Sheet

FOOT ASSISTED PLUNGER CONSTRUCTION

BACKGROUND OF THE INVENTION

CROSS REFERENCE TO RELATED APPLICATIONS

Not applicable.

1. Field of the Invention

The present invention relates to the field of plunger constructions in general and in particular to a foot assisted plunger construction.

2. Description of Related Art

As can be seen by reference to the following U.S. Pat. Nos. 6,374,427; 5,353,442; 5,335,374; 4,745,641; and, 3,644,943, the prior art is replete with myriad and diverse conventional, as well as, power assisted plunger constructions.

While all of the aforementioned prior art constructions are more than adequate for the basic purpose and function for which they have been specifically designed, they are uniformly deficient with respect to their failure to provide a simple, efficient, and practical foot power assisted plunger construction that allows a downward force to be exerted on the deformable cup by a selected one of the user's feet, as well as, one or more of their arms.

While most homeowners normally do not require enhanced compression characteristics for their "plumber's helpers," there are many industrial and high density occupancy environments wherein, a fairly significant number of drains must be serviced in a short period of time.

As a consequence of the foregoing situation, there has existed a longstanding need among all plunger users for a new and improved foot assisted plunger construction that adds the power of one of the plunger user's legs to achieve improved and rapid compression of the deformable plunger cup to free blocked drains; and, the provision of such a construction is the stated objective of the present invention.

BRIEF SUMMARY OF THE INVENTION

Briefly stated, the foot assisted plunger construction that forms the basis of the present invention comprises a unique, elongated, generally D-shaped handle member which is adapted to be connected to a variety of well recognized deformable plunger cup members for the purpose of delivering an enhanced compressive force to the cup member from the specially configured handle member.

As will be explained in greater detail further on in the specification, the handle member is provided with an elongated opening dimensioned to receive at least the lower portion of a user's leg and foot wherein, the upper portion of the handle member may be grasped by either or both of the user's arms.

In addition, the lower portion of the handle member is provided with an enlarged base plate having a high friction surface to prevent slippage of the user's foot on the base plate as the user applies a downward force on the base plate.

Furthermore, the base plate is provided with a downwardly depending adapter element that allows the handle member to be connected to any one of a number of standard plunger cup structures.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
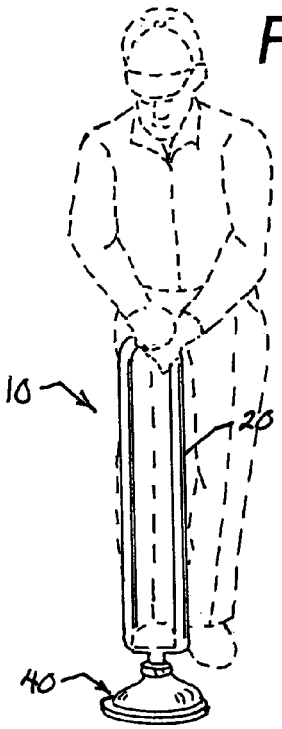
FIG. 1 is a perspective view of the foot assisted plunger construction in use.

As can be seen by reference to the drawings, and in particular to FIG. 1, the foot assisted plunger construction that forms the basis of the present invention is designated generally by the reference number 10. The plunger construction comprises in general a handle member 20 and a selected one of a number of standard deformable plunger cup members 40. These structural components will now be described in seriatim fashion.

Figure 2:
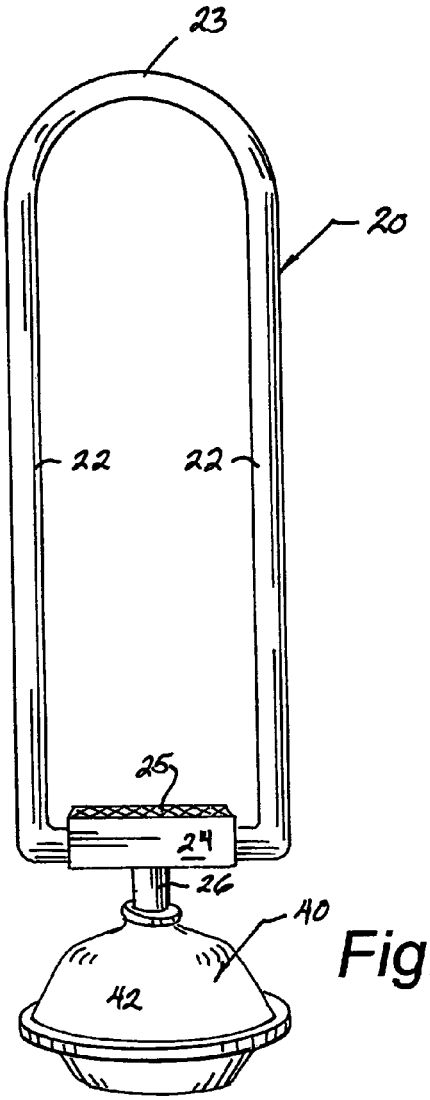
FIG. 2 is an isolated front perspective view of the foot assisted plunger construction; and, FIG. 3 is an exploded perspective view of the lower portion of the handle member and a bell shaped cup member.
Figure 3:
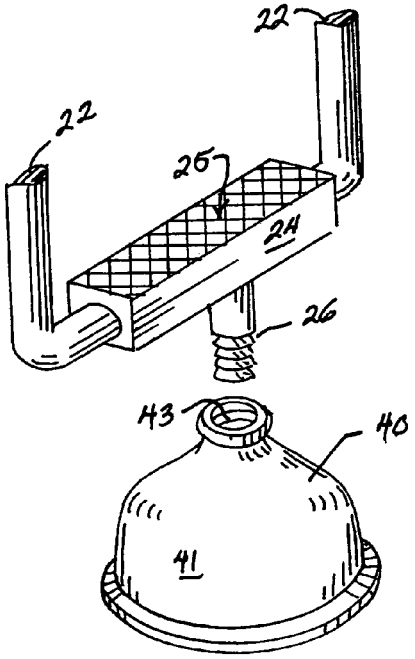

As shown in FIGS. 2 and 3, the handle member 20 has an elongated D-shaped configuration that defines a central opening 21 that is dimensioned to receive the lower portion of a user's leg and foot.

The intermediate portion of the handle member 20 comprises a pair of elongated support arms 22 22 which transition on their upper ends in an arcuate handle element 23 and which are joined together on their lower ends by a horizontally disposed base plate 24 provided with a high friction surface 25 that is intended to prevent the slippage of the user's foot when a downward force is exerted on the base plate.

As can also be seen by reference to FIGS. 2 and 3, the bottom of the base plate 24 is further provided with a downwardly depending adapter element 26 that allows the handle member 20 to be secured to the mounting receptacle 43 of a number of different standard deformable plunger cup members 40.

Still referring to FIGS. 2 and 3, it can be seen that two of the most recognizable deformable cup member configurations are the bell shaped cup member 41 depicted in FIG. 3 and the bellows shaped cup member 42 depicted in FIG. 2.

In keeping with the teachings of this invention, the adapter element 26 is also suitable for use with the well recognized accordian or pleated cup member configurations (not shown), as well as, other generally standard cup member configurations.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. In a plunger construction including a standard well recognized deformable plunger cup member having a mounting receptacle, the improvement comprising an elongated handle member having a pair of elongated support arms, the lower ends of which are connected together by a base plate provided with an adapter element that is dimensioned to be received in the mounting receptacle of a plunger cup member.

2. The improvement as in claim 1; wherein, the support arm and base plate define at least in part an opening that is dimensioned to receive the foot of a user.

3. The improvement as in claim 2; wherein, the base plate is further provided with a high friction surface.

4. The improvement as in claim 3; wherein, the upper ends of the support arms are connected to one another by a handle element.

5. The improvement as in claim 4; wherein, said handle element has an arcuate configuration.

* * * * *